US011513447B2

(12) United States Patent
Takabayashi et al.

(10) Patent No.: US 11,513,447 B2
(45) Date of Patent: Nov. 29, 2022

(54) CARRIER FOR FORMING ELECTROPHOTOGRAPHIC IMAGE, DEVELOPER FOR FORMING ELECTROPHOTOGRAPHIC IMAGE, ELECTROPHOTOGRAPHIC IMAGE FORMING METHOD, ELECTROPHOTOGRAPHIC IMAGE FORMING APPARATUS, AND PROCESS CARTRIDGE

(71) Applicant: RICOH COMPANY, LTD., Tokyo (JP)

(72) Inventors: Yuuya Takabayashi, Shizuoka (JP); Shinya Nakagawa, Fukui (JP); Katsuhiko Fujii, Shizuoka (JP); Junjiroh Sogame, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 34 days.

(21) Appl. No.: 17/091,162

(22) Filed: Nov. 6, 2020

(65) Prior Publication Data

US 2021/0141319 A1 May 13, 2021

(30) Foreign Application Priority Data

Nov. 11, 2019 (JP) ..... JP2019-203894
Jul. 10, 2020 (JP) ..... JP2020-119353

(51) Int. Cl.
*G03G 9/113* (2006.01)
*G03G 21/18* (2006.01)

(52) U.S. Cl.
CPC ..... *G03G 9/1139* (2013.01); *G03G 9/1136* (2013.01); *G03G 21/1814* (2013.01)

(58) Field of Classification Search
CPC ..... G03G 9/113; G03G 9/1139
See application file for complete search history.

(56) References Cited

U.S. PATENT DOCUMENTS 5,085,964 A * 2/1992 Kawata ..... G03G 9/1136 430/111.32
2016/0238960 A1* 8/2016 Fukushima ..... G03G 9/1133
2017/0185000 A1 6/2017 Nagayama et al.
2018/0113393 A1 4/2018 Seki et al.
2018/0120724 A1 5/2018 Sakata et al.
2019/0018331 A1 1/2019 Takii et al.
2020/0103778 A1 4/2020 Takabayashi et al.

FOREIGN PATENT DOCUMENTS

EP 3 432 075 A1 1/2019
EP 3432075 * 1/2019 ..... G03G 9/1139
JP 2010-230836 10/2010
(Continued)

OTHER PUBLICATIONS

Extended European Search Report dated Mar. 5, 2021 in European Patent Application No. 20206020.8, 7 pages.

*Primary Examiner* — Peter L Vajda
(74) *Attorney, Agent, or Firm* — Grüneberg and Myers PLLC

(57) ABSTRACT

A carrier for forming an electrophotographic image is provided. The carrier comprises a core particle and a resin layer coating the core particle. The resin layer contains a chargeable particle A, a conductive particle B, a dispersing agent, and a defoaming agent.

17 Claims, 1 Drawing Sheet

(56) References Cited

FOREIGN PATENT DOCUMENTS

| | | | |
|---|---|---|---|
| JP | 2011-209678 | | 10/2011 |
| JP | 2016-212254 | | 12/2016 |
| JP | 2017-167387 | | 9/2017 |
| JP | 2018-155970 | A | 10/2018 |
| JP | 2020-154022 | | 9/2020 |
| WO | WO 2014/003200 | A1 | 1/2014 |

* cited by examiner

CARRIER FOR FORMING ELECTROPHOTOGRAPHIC IMAGE, DEVELOPER FOR FORMING ELECTROPHOTOGRAPHIC IMAGE, ELECTROPHOTOGRAPHIC IMAGE FORMING METHOD, ELECTROPHOTOGRAPHIC IMAGE FORMING APPARATUS, AND PROCESS CARTRIDGE

CROSS-REFERENCE TO RELATED APPLICATIONS

This patent application is based on and claims priority pursuant to 35 U.S.C. § 119(a) to Japanese Patent Application Nos. 2019-203894 and 2020-119353, filed on Nov. 11, 2019 and Jul. 10, 2020, respectively, in the Japan Patent Office, the entire disclosure of each of which is hereby incorporated by reference herein.

BACKGROUND

Technical Field

The present disclosure relates to a carrier for forming an electrophotographic image, a developer for forming an electrophotographic image, an electrophotographic image forming method, an electrophotographic image forming apparatus, and a process cartridge.

Description of the Related Art

In an electrophotographic image forming process, an electrostatic latent image is formed on an electrostatic latent image bearer (e.g., photoconductive substance), and a charged toner is attached to the electrostatic latent image to form a toner image. The toner image is then transferred onto a recording medium and fixed thereon, thereby outputting an image. In recent years, electrophotographic technology for multifunction peripherals and printers has rapidly expanded from monochrome printing to full-color printing, and the market of full-color printing is still expanding.

In a typical full-color image forming processes, three color toners including yellow, magenta, and cyan toners, or four color toners further including black toner in addition to the three color toners, are stacked to reproduce all possible colors. Therefore, to obtain a vivid full-color image with excellent color reproducibility, the surface of the fixed toner image should be smoothened to reduce light scattering.

For this reason, many of conventional full-color copiers have achieved high-gloss images by increasing the amount of toner attached to an electrostatic latent image to smooth the toner image. This undesirably causes the deteriorated toner (or spent toner) to adhere to the surface of a carrier during a long-term printing. In particular, the spent toner degrades the carrier to cause an increase of resistance and a decrease of charging ability. When the charging ability of the carrier is lowered, toner scattering occurs to contaminate the inside of the apparatus, which causes a malfunction such as erroneous detection by sensors.

In the field of production printing where the market is expanding lately, higher image quality than ever has been demanded. The carrier is subjected to a strong stress inside the developing device in high-speed development, and the coating resin of the carrier wears to expose the core material. As a result, the carrier is transferred onto the electrostatic latent image bearer. This phenomenon is generally called "carrier deposition". The carrier deposition causes an undesirable phenomenon in which white spots (where toner is partly absent like white dots) appear at the edge and central portions of the image. Measures against this phenomenon have more severely demanded in recent years.

On the other hand, carrier deposition can be prevented by designing the carrier to have a high level of resistance from the initial stage so that the resistance is maintained at a high level. In this case, however, the surface charge of the carrier cannot be appropriately leaked immediately after image development, which may cause an undesirable phenomenon in which the edge portion of a halftone image becomes less dense.

On the other hand, in recent years, toners have become fixable at lower temperatures to reduce power consumption and the printing speed has been increased, so that adhesion of the spent toner to the carrier is more likely to occur. Furthermore, toners tend to contain many additives in response to the demand for higher image quality. However, the spent additives adhere to the carrier to cause a decrease of the amount of toner charge and a decrease of the resistance to toner scattering and background fog. In addition, since the addition amount of chargeable particles has been reduced to make toners be fixable at lower temperatures, the supplied toner cannot be sufficiently mixed with the developer and cannot be charged, thus causing toner scattering.

SUMMARY

In accordance with some embodiments of the present invention, a carrier for forming an electrophotographic image is provided. The carrier comprises a core particle and a resin layer coating the core particle. The resin layer contains a chargeable particle A, a conductive particle B, a dispersing agent, and a defoaming agent.

BRIEF DESCRIPTION OF THE DRAWINGS

A more complete appreciation the disclosure and many of the attendant advantages thereof will be readily obtained as the same becomes better understood by reference to the following detailed description when considered in connection with the accompanying drawings, wherein.

Figure 1:
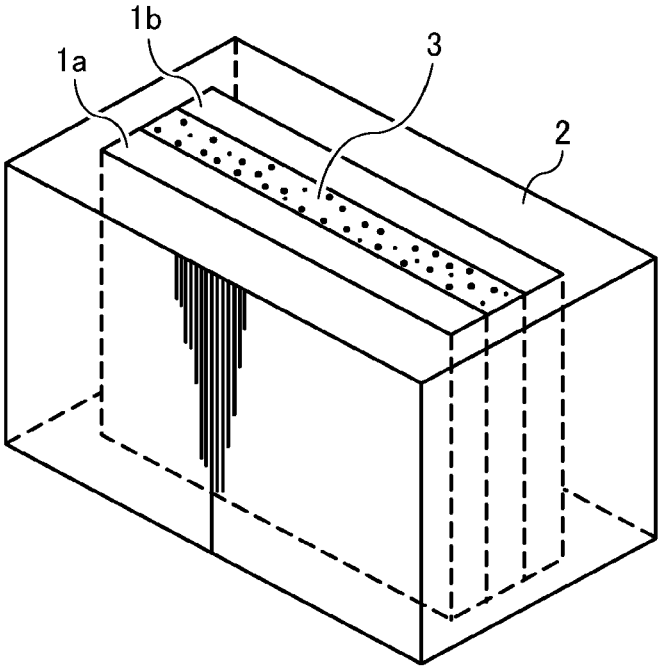
FIG. 1 is a diagram illustrating a cell used to measure the volume resistivity of a carrier.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a carrier for forming an electrophotographic image is provided that is capable of performing low-resistance control and charge control in accordance with a desired image and of suppressing the occurrence of carrier deposition and toner scattering.

The carrier according to an embodiment of the present invention is described in detail below.

In accordance with some embodiments of the present invention, a carrier for forming an electrophotographic image is provided that comprises a core particle and a resin layer coating the core particle. The resin layer contains at least two types of particles, i.e., a chargeable particle A and a conductive particle B. The resin layer further contains a dispersing agent and a defoaming agent.

According to an embodiment of the present invention, the resin layer contains at least a chargeable particle A and a conductive particle B. To adjust the resistance to be within a low resistance region while ensuring sufficient charge holding ability, two types of particles are introduced; the chargeable particle A having high chargeability with toner and the conductive particle B having conductivity. In addition to the conductive particle B, carbon black that has an excellent resistance adjusting function may be further introduced as another type of conductive particle B. By making the amount of carbon black gradually reduced toward the surface layer, the amount of carbon black contained in the coating component that has been released from the carrier upon scraping off of the resin layer is reduced. As a result, the occurrence of color stains on the toner can be prevented. In response to a concern for an increase of the electrical resistance near the surface layer due to the reduction of the amount of carbon black, the amount of the conductive particle B is made increased toward the surface layer side where the amount of carbon black is small. As a result, the electrical resistance of the surface layer side becomes equivalent to that of the deep layer side having a high carbon black concentration.

In addition, the carrier according to an embodiment of the present invention contains a dispersing agent in the resin layer. When a coating liquid for forming the resin layer that contains a resin, inorganic particles, a diluting solvent, etc., further contains the dispersing agent, the inorganic particles can be dispersed to the primary particle size and the particle size distribution thereof can be narrowed. As a result, particles that are weakly fixed to the surface of the carrier without being sufficiently embedded in the binder resin, such as coarse particles, are eliminated. Such particles are likely to be detached due to stress at the initial stage of printing, and the carrier resistance is thereby lowered, which causes carrier deposition on solid image portions. This phenomenon can be prevented by adding the dispersing agent in the coating liquid.

The dispersing agent has both a group having an affinity for the resin and a group having an affinity for the inorganic particles. Therefore, the dispersing agent has an effect of improving the affinity between the resin and the inorganic particles. As a result, the adhesion between the resin and the inorganic particles is enhanced in the resin layer to form a stronger film, and the particles are less likely to be detached from the resin layer even under stress over time during printing. Thus, the occurrence of carrier deposition on solid image portions can be prevented over time. In addition, since detachment of the chargeable particle A that charges the toner is prevented, the charging ability of the toner can be maintained over time, preventing the occurrence of toner scattering.

In addition, a defoaming agent can be used in combination with the dispersing agent. When a coating liquid for forming the resin layer that contains a resin, inorganic particles, a diluting solvent, etc., further contains the dispersing agent, the coating liquid is likely to foam because the dispersing agent is a surfactant. If such a foamed coating liquid is used for coating, the resulting resin layer has incorporated bubbles therein, and voids derived from the bubbles are generated in the resin layer. The voids in the resin layer significantly reduce the durability of the film, and scraping of the film progresses overtime during printing. For this reason, it is not possible to achieve the above-described effect of preventing the occurrence of carrier deposition on solid image portions and toner scattering over time during printing only by the use of the dispersing agent. When the defoaming agent is used in combination with the dispersing agent, the coating liquid is suppressed from foaming, thereby eliminating generation of voids in the resin layer. Thus, such a carrier solves the problem of deterioration of the film durability over time during printing and prevents the occurrence of carrier deposition on solid image portions and toner scattering not only at the initial stage of printing but also over time during printing.

The dispersing agent is not particularly limited. Examples thereof include, but are not limited to, phosphate-based surfactants, sulfate-based surfactants, sulfonic-acid-based surfactants, and carboxylic-acid-based surfactants. Among these, phosphate-based surfactants are preferred. The use of the dispersing agent makes it possible to satisfactorily disperse the chargeable particle A and the conductive particle B to the primary particle size, homogenize the distribution of the inorganic particles in the resin layer, and enhance the affinity between the resin and the inorganic particles. In addition, as a result of studies by the inventors of the present invention, it has been found that the addition of a dispersing agent having a phosphate structure further improves the margin for toner scattering. This is because the phosphate structure is positively chargeable, while a toner is generally negatively chargeable. When a dispersing agent containing a phosphate is added, the ability for charging the toner is improved as compared with the case where it is not added. In particular, the charging ability immediately after mixing and stirring with toner, in other words, the charge rising property, is improved. Therefore, the occurrence of toner scatting at the time of toner supply, caused when the supplied toner is insufficiently charged, is effectively prevented.

The phosphate-based surfactant serving as the dispersing agent preferably contains a phosphate as a main component. In order to be the "main component" in the present embodiment, the proportion of the phosphate in the dispersing agent is preferably 50% by mass or more, and more preferably 90% by mass or more.

Examples of commercially-available products thereof include, but are not limited to, SOLSPERSE 2000, 2400, 2600, 2700, and 2800 (manufactured by Zeneca), AJISPER PB711, PA111, PB811, and PW911 (manufactured by Ajinomoto Co., Inc.), EFKA-46, 47, 48, and 49 (manufactured by EFKA Chemicals B.V.), DISPERBYK 160, 162, 163, 166, 170, 180, 182, 184, and 190 (manufactured by BYK-Chemie GmbH), and FLOWLEN DOPA-158, 22, 17, G-700, TG-720W, and 730W (manufactured by Kyoeisha Chemical Co., Ltd.).

The addition amount of the dispersing agent is preferably from 0.5 to 10.0 parts by mass with respect to 100 parts by mass of the chargeable particle A and the conductive particle B in total. When the addition amount of the dispersing agent is less than 0.5 parts by mass, not all the inorganic particles can be dispersed to the primary particle size, and agglomerated inorganic particles remain. These agglomerated particles are not sufficiently immobilized on the resin layer and detached due to stress at the initial stage of printing. Thus, the resistance is lowered, and carrier deposition occurs. In addition, the amount of the dispersing agent present on the outermost surface of the resin layer is small. Thus, the charge rising property is not good, which is not advantageous in preventing toner scattering.

When the addition amount of the dispersing agent exceeds 10.0 parts by mass, the dispersing agent components which cannot be adsorbed to the inorganic particles is present in the coating resin in a large amount. For this reason, the proportion of the binder resin in the resin layer is reduced, the durability of the film is lowered, and the inorganic particles are detached over time during printing, thus causing carrier deposition on solid image portions and toner scattering over time during printing. Therefore, the addition amount of the dispersing agent is preferably from 0.5 to 10.0 parts by mass, more preferably from 1.0 to 3.0 parts by mass, with respect to 100 parts by mass of the chargeable particle A and the conductive particle B in total.

The defoaming agent is not particularly limited. Examples thereof include silicone-based, acrylic-based, and vinyl-based defoaming agents. Among these, silicone-based defoaming agents are preferred. The defoaming effect is exerted depending on the balance between compatibility and incompatibility with a solvent. Silicone-based defoaming agents have a good balance between compatibility and incompatibility and exerts a high defoaming effect even with a small amount, preventing generation of voids in the coating resin. Preferred examples of the silicone-based defoaming agents include silicone oils.

Examples of commercially-available products thereof include, but are not limited to, KS-530, KF-96, KS-7708, KS-66, and KS-69 (manufactured by Silicone Division of Shin-Etsu Chemical Co., Ltd.), TSF451, THF450, TSA720, YSA02, TSA750, and TSA750S (manufactured by Momentive Performance Materials Inc.), BYK-065, BYK-066N, BYK-070, BYK-088, and BYK-141 (manufactured by BYK-Chemie GmbH), and DISPARLON 1930N, DISPARLON 1933, and DISPARLON 1934 (manufactured by Kusumoto Chemicals, Ltd.).

The addition amount of solid contents of the defoaming agent is preferably from 0.05 to 0.35 parts by mass with respect to 100 parts by mass of the resin layer.

When the addition amount of solid contents of the defoaming agent is less than 0.05 parts by mass, the defoaming effect cannot be sufficiently exerted and voids are generated in the coating resin. When the addition amount of solid contents of the defoaming agent exceeds 0.35 parts by mass, it is likely that a coated surface defect called "crawling" appears, the resin layer on the carrier surface becomes brittle, the inorganic particles are detached, and carrier deposition significantly occurs on solid image portions. Assuming that the solid content concentration of the defoaming agent is 1%, the amount of the defoaming agent added to the coating liquid is preferably from 1.0 to 10.0 parts by mass, more preferably from 3.0 to 7.0 parts by mass, with respect to 100 parts by mass of the coating liquid.

Preferably, the chargeable particle A comprises an inorganic particle selected from the group consisting of barium sulfate, magnesium oxide, magnesium hydroxide, and hydrotalcite. When a negatively-chargeable toner is used, the charge imparting ability is stabilized for an extended period of time by selecting a positively-chargeable material. In particular, barium sulfate is preferred for its high charging ability for negatively-chargeable toners and white color that exerts little influence on the color of the toner even when it is detached from the coating resin.

Further, the chargeable particle A preferably has an equivalent circle diameter of from 400 to 900 nm. Such a chargeable particle A can be present in a convex state on the surface of the carrier coating layer, which ensures toner charging ability. To ensure reliable charging ability and developing ability, the equivalent circle diameter of the chargeable particle A is more preferably 600 nm or more. Further, when the equivalent circle diameter of the chargeable particle A is 900 nm or less, the particle diameter of the chargeable particle A will not be too large with respect to the thickness of the coating film. Therefore, the chargeable particle A is sufficiently retained in the binder resin and less likely to be detached from the coating resin film, which is preferred.

As the conductive particle B, any known or new material having a powder resistivity of 200 Ω·cm or less can be used. By the use of the chargeable particle A and the dispersing agent, the durability of the film is improved, and the surface of the resin layer containing the conductive particle B is prevented from being scraped. However, the resin layer gets scraped little by little through a long-term use. At that time, to minimize toner color contamination caused by the conductive particle B which has been detached from the resin layer or the conductive particle B which is contained in the detached resin layer, it is preferable that the conductive particle B be close to white or colorless as possible.

Examples of materials having good color and conductive function include, but are not limited to, doped tin oxides that are doped with tungsten, indium, phosphorus, or an oxide of any of these substances. These doped tin oxides can be used as they are or provided to the surfaces of base particles. As the base particles, either known or new material can be used. Examples thereof include, but are not limited to, aluminum oxide and titanium oxide.

Further, the conductive particle B preferably has an equivalent circle diameter of from 600 to 1,000 nm. When the equivalent circle diameter is 600 nm or more, the particle diameter is not too small, and the carrier resistance can be efficiently reduced. When the equivalent circle diameter is 1,000 nm or less, the conductive particle B is less likely to be detached from the surface of the resin layer. As the conductive particle B that has the resistance adjusting function are less likely to be detached, the carrier resistance is less likely to vary, and the reliability of image quality is improved.

The coating resin of the carrier may include a silicone resin, an acrylic resin, or a combination thereof. Acrylic resins have high adhesiveness and low brittleness and thereby exhibit superior wear resistance. At the same time, acrylic resins have a high surface energy. Therefore, when used in combination with a toner which easily adheres thereto, the adhered toner components may be accumulated on the acrylic resin to cause a decrease of the amount of charge. On the other hand, silicone resins have a low surface energy, to which the toner components are less likely to adhere. Detachment of the coating film occurs, and accumulation of the adhered toner components is prevented. Therefore, the above-described problem can be solved by using a silicon resin as the carrier coating resin in combination with an acrylic resin. At the same time, silicone resins have low adhesiveness and high brittleness and thereby exhibit poor wear resistance. Thus, it is preferable that these two types or resins be used in a good balance to provide a coating layer having wear resistance to which toner is difficult to adhere with a remarkable improvement effect. This is because silicone resins have a low surface energy, to which the toner components are less likely to adhere, which prevents accumulation of the adhered toner components that causes detachment of the coating film.

In the present disclosure, silicone resins refer to all generally known silicone resins. Examples thereof include, but are not limited to, straight silicone resins consisting of organosiloxane bonds, and modified silicone resins (e.g., alkyd-modified, polyester-modified, epoxy-modified, acrylic-modified, and urethane-modified silicone resins). Specific examples of commercially-available products of the straight silicone resins include, but are not limited to, KR271, KR255, and KR152 (manufactured by Shin-Etsu Chemical Co., Ltd.) and SR2400, SR2406, and SR2410 (manufactured by Dow Corning Toray Silicone Co., Ltd.). Each of these silicone resins may be used alone or in combination with other components such as a cross-linking component and a charge amount controlling component. Specific examples of the modified silicone resins include, but are not limited to, KR206 (alkyd-modified), KR5208 (acrylic-modified), ES1001N (epoxy-modified), and KR305 (urethane-modified) (manufactured by Shin-Etsu Chemical Co., Ltd.); and SR2115 (epoxy-modified) and SR2110 (alkyd-modified) (manufactured by Dow Corning Toray Silicone Co., Ltd.).

In the present disclosure, acrylic resins refer to all known resins containing an acrylic component and are not particularly limited. Each of these acrylic resins may be used alone or in combination with at least one cross-linking component. Specific examples of the cross-linking component include, but are not limited to, amino resins and acidic catalysts. Specific examples of the amino resins include, but are not limited to, guanamine resin and melamine resin. The acidic catalysts here refer to all materials having a catalytic action. Specific examples thereof include, but are not limited to, those having a reactive group of a completely alkylated type, a methylol group type, an imino group type, or a methylol/imino group type.

Preferably, the carrier according to an embodiment of the present invention has a volume average particle diameter of from 28 to 40 μm. When the volume average particle diameter of the carrier particles is 28 μm or more, carrier deposition does not occur. When it is 40 μm or less, reproducibility of image details does not deteriorate, and a fine image can be formed.

The volume average particle diameter can be measured by a particle size analyzer MICROTRAC HRA9320-X100 (manufactured by Nikkiso Co., Ltd.).

Preferably, the carrier according to an embodiment of the present invention has a volume resistivity of from 8 to 16 (Log Ω·cm). When the volume resistivity is 8 (Log Ω·cm) or more, carrier deposition does not occur in non-image portions. When the volume resistivity is 16 (Log Ω·cm) or less, the edge effect does not become an unacceptable level.

The volume resistivity can be measured using a cell illustrated in FIG. 1. Specifically, the cell comprises a fluororesin container 2 in which electrodes 1*a* and 1*b* each having a surface area of 2.5 cm×4 cm are accommodated with a distance of 0.2 cm therebetween. The cell is filled with a carrier 3 and thereafter subjected to tapping 10 times under the condition that the falling height is 1 cm and the tapping speed is 30 times per minute. Next, a direct-current voltage of 1,000 V is applied to between the electrodes 1*a* and 1*b*, and 30 seconds later, a resistance value r (Ω) is measured using a HIGH RESISTANCE METER 4329A (manufactured by Yokogawa-Hewlett-Packard, Ltd.). The volume resistivity (Ω·cm) is calculated from the following formula 1.

$$r\times(2.5\times4)/0.2 \qquad \text{Formula 1}$$

When the coating resin comprises a silicone resin, an acrylic resin, or a combination thereof, it is possible to increase film strength by cross-linking silanol groups by causing a condensation by a polycondensation catalyst.

Examples of the polycondensation catalysts include, but are not limited to, titanium-based catalysts, tin-based catalysts, zirconium-based catalysts, and aluminum-based catalysts. Among these catalysts, titanium-based catalysts are preferred for their excellent effects, and titanium diisopropoxybis(ethylacetoacetate) is most preferred. The reason for this is considered that this catalyst effectively accelerates condensation of silanol groups and is less likely to be deactivated.

Preferably, the resin layer composition contains a silane coupling agent. In this case, the particles can be reliably dispersed therein.

Specific examples of the silane coupling agent include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyldisilazane, γ-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl)ammonium chloride. Two or more of these materials can be used in combination.

Specific examples of commercially-available products of the silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (manufactured by Toray Silicone Co., Ltd.).

Preferably, the proportion of the silane coupling agent to the silicone resin is from 0.1% to 10% by mass. When the proportion of the silane coupling agent is 0.1% by mass or more, the adhesion strength between the core particles or conductive particles and the silicone resin does not deteriorate, and the resin layer does not fall off during a long-term use. When the proportion is 10% by mass or less, toner filming does not occur during a long-term use.

In the present disclosure, the core particle is not particularly limited as long as it is a magnetic material. Specific examples thereof include, but are not limited to: ferromagnetic metals such as iron and cobalt; iron oxides such as magnetite, hematite, and ferrite; various alloys and compounds; and resin particles in which these magnetic materials are dispersed. Among these materials, Mn ferrite, Mn—Mg ferrite, and Mn—Mg—Sr ferrite are preferred because they are environmentally-friendly.

The volume average particle diameter of the core particle of the carrier is not particularly limited. For preventing the occurrence of carrier deposition and carrier scattering, the volume average particle diameter is preferably 20 μm or more. For preventing the production of abnormal images (e.g., stripes made of carrier particles) and deterioration of image quality, the volume average particle diameter is preferably 100 μm or less. In particular, a core particle having a volume average particle diameter of from 28 to 40 μm can meet a recent demand for higher image quality.

Preferably, the resin layer has an average film thickness of 0.50 μm or more. When the average film thickness is 0.50 μm or more, the coating film is free of defective portion and can reliably retain particles.

A developer for forming an electrophotographic image according to an embodiment of the present invention contains the carrier according to an embodiment of the present invention.

A two-component developer according to an embodiment of the present invention contains the carrier according to an embodiment of the present invention and a toner. Preferably, the toner is a negatively-chargeable toner.

The toner contains a binder resin and a colorant. The toner may be a toner for either black-and-white printing or color printing. The toner may further contain a release agent so that the toner can be used in oilless fixing systems in which the fixing roller is free of application of toner adherence preventing oil. Although such a toner is likely to cause filming, the carrier according to an embodiment of the present invention can prevent the occurrence of filming, and the developer according to an embodiment of the present invention can provide high-quality images for an extended period of time. Color toners, particularly yellow toners, generally have a drawback that the color is contaminated with the resin layer which has been scraped off from the carrier. The developer according to an embodiment of the present invention can prevent such a contamination of the color.

The toner can be produced by known methods such as pulverization methods and polymerization methods. In a typical pulverization method, toner materials are melt-kneaded, the melt-kneaded product is cooled and pulverized into particles, and the particles are classified by size, thus preparing mother particles. To more improve transferability and durability, an external additive is added to the mother particles, thus obtaining a toner.

Specific examples of the kneader for kneading the toner materials include, but are not limited to, a batch-type double roll mill; BANBURY MIXER; double-axis continuous extruders such as TWIN SCREW EXTRUDER KTK (manufactured by Kobe Steel, Ltd.), TWIN SCREW COMPOUNDER TEM (manufactured by Toshiba Machine Co., Ltd.), MIRACLE K.C.K (manufactured by Asada Iron Works Co., Ltd.), TWIN SCREW EXTRUDER PCM (manufactured by Ikegai Co., Ltd.), and KEX EXTRUDER (manufactured by Kurimoto, Ltd.); and single-axis continuous extruders such as KOKNEADER (manufactured by Buss Corporation).

The cooled melt-kneaded product may be coarsely pulverized by a HAMMER MILL or a ROTOPLEX and thereafter finely pulverized by a jet-type pulverizer or a mechanical pulverizer. Preferably, the pulverization is performed such that the resulting particles have an average particle diameter of from 3 to 15 μm.

When classifying the pulverized melt-kneaded product, a wind-power classifier may be used. Preferably, the classification is performed such that the resulting mother particles have an average particle diameter of from 5 to 20 μm.

The external additive is added to the mother particles by being stir-mixed therewith by a mixer, so that the external additive gets adhered to the surfaces of the mother particles while being pulverized.

Specific examples of the binder resin include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Specific examples of usable binder resins for pressure fixing include, but are not limited to: polyolefins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-maleic acid anhydride copolymer, maleic-acid-modified phenol resin, and phenol-modified terpene resin. Two or more of these resins can be used in combination.

Specific examples of the colorant (i.e., pigments and dyes) include, but are not limited to, yellow pigments such as Cadmium Yellow, Mineral Fast Yellow, Nickel Titanium Yellow, Naples Yellow, Naphthol Yellow S, Hansa Yellow G. Hansa Yellow 10G, Benzidine Yellow GR, Quinoline Yellow Lake, Permanent Yellow NCG, and Tartrazine Lake; orange pigments such as Molybdenum Orange, Permanent Orange GTR, Pyrazolone Orange, Vulcan Orange, Indanthrene Brilliant Orange RK, Benzidine Orange G, and Indanthrene Brilliant Orange GK; red pigments such as Red Iron Oxide, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B; violet pigments such as Fast Violet B and Methyl Violet Lake; blue pigments such as Cobalt Blue, Alkali Blue, Victoria Blue lake, Phthalocyanine Blue, Metal-free Phthalocyanine Blue, partial chlorination product of Phthalocyanine Blue, Fast Sky Blue, and Indanthrene Blue BC; green pigments such as Chrome Green, chrome oxide, Pigment Green B, and Malachite Green Lake; and black pigments such as azine dyes (e.g., carbon black, oil furnace black, channel black, lamp black, acetylene black, aniline black), metal salt azo dyes, metal oxides, and combined metal oxides. Two or more of these colorants can be used in combination.

Specific examples of the release agent include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further contain a charge controlling agent. Specific examples of the charge controlling agent include, but are not limited to: nigrosine; azine dyes having an alkyl group having 2 to 16 carbon atoms; basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045). C. I. Basic Green 1 (C. I. 42040), and C. I. Basic Green 4 (C. I. 42000); lake pigments of these basic dyes; quaternary ammonium salts such as C. I. Solvent Black 8 (C. I. 26150), benzoylmethylhexadecyl ammonium chloride, and decyltrimethyl chloride; dialkyl (e.g., dibutyl, dioctyl) tin compounds; dialkyl tin borate compounds; guanidine derivatives; polyamine resins such as vinyl polymers having amino group and condensed polymers having amino group; metal complex salts of monoazo dyes; metal complexes of salicylic acid, dialkyl salicylic acid, naphthoic acid, and dicarboxylic acid with Zn, Al, Co, Cr, and Fe; sulfonated copper phthalocyanine pigments; organic boron salts; fluorine-containing quaternary ammonium salts; and calixarene compounds. Two or more of these materials can be used in combination. For color toners other than black toner, metal salts of salicylic acid derivatives, which are white, are preferred.

Specific examples of the external additive include, but are not limited to, inorganic particles such as silica, titanium oxide, alumina, silicon carbide, silicon nitride, and boron nitride, and resin particles such as polymethyl methacrylate particles and polystyrene particles having an average particle diameter of from 0.05 to 1 μm, obtainable by soap-free emulsion polymerization. Two or more of these materials can be used in combination. Among these, metal oxide particles (e.g., silica, titanium oxide) whose surfaces are hydrophobized are preferred. When a hydrophobized silica and a hydrophobized titanium oxide are used in combination with the amount of the hydrophobized titanium oxide greater than that of the hydrophobized silica, the toner provides excellent charge stability regardless of humidity.

The carrier according to an embodiment of the present invention can be used for a developer for replenishment that contains the carrier and a toner. This developer for replenishment can be applied to an image forming apparatus which forms an image while discharging surplus developer in the developing device, for reliably providing high image quality for an extremely extended period of time. This is because the deteriorated carrier particles in the developing device are replaced with non-deteriorated carrier particles contained in the developer for replenishment. Thus, the amount of charge is kept constant and images are reliably produced for an extended period of time. Such a system is particularly advantageous for printing an image with a high image area occupancy. When printing an image having a high image area occupancy, generally, the charge of the carrier particles gets deteriorated as toner particles get adhered to the carrier particles. By contrast, in the above system, a large amount of carrier particles is supplied when printing an image having a high image area occupancy, and deteriorated carrier particles can be more frequently replaced with non-deteriorated carrier particles. Accordingly, high image quality is reliably provided for an extremely extended period of time.

Preferably, the developer for replenishment contains 2 to 50 parts by mass of the toner with respect to 1 part by mass of the carrier. When the amount of the toner is 2 parts by mass or more, the amount of the supplied carrier is not too large and the carrier concentration in the developing device is not too high. Therefore, the amount of charge of the developer is unlikely to increase. As the amount of charge of the developer increases, the developing ability deteriorates, and the image density lowers. When the amount of the toner is 50 parts by mass or less with respect to 1 part by mass of the carrier, the proportion of the carrier in the developer for replenishment is not so small that replacement of the carrier particles becomes more frequent in the image forming apparatus, with which an effect on deterioration of the carrier can be expected.

Preferably, the toner concentration in the two-component developer is in the range of from 4% to 9% by mass. When the toner concentration is 4% by mass or more, the amount of toner is large, and an appropriate image density can be obtained. When the toner concentration is 9% by mass or less, it is easy for the carrier to hold the toner, and toner scattering is less likely to occur.

Image Forming Method

An image forming method according to an embodiment of the present invention includes the processes of: forming an electrostatic latent image on an electrostatic latent image bearer; developing the electrostatic latent image formed on the electrostatic latent image bearer with the two-component developer according to an embodiment of the present invention to form a toner image; transferring the toner image formed on the electrostatic latent image bearer onto a recording medium; and fixing the toner image on the recording medium.

Process Cartridge

A process cartridge according to an embodiment of the present invention includes: an electrostatic latent image bearer; a charger configured to charge a surface of the electrostatic latent image bearer; a developing device containing the two-component developer according to an embodiment of the present invention, configured to develop an electrostatic latent image formed on the electrostatic latent image bearer with the two-component developer; and a cleaner configured to clean the electrostatic latent image bearer.

Figure 2:
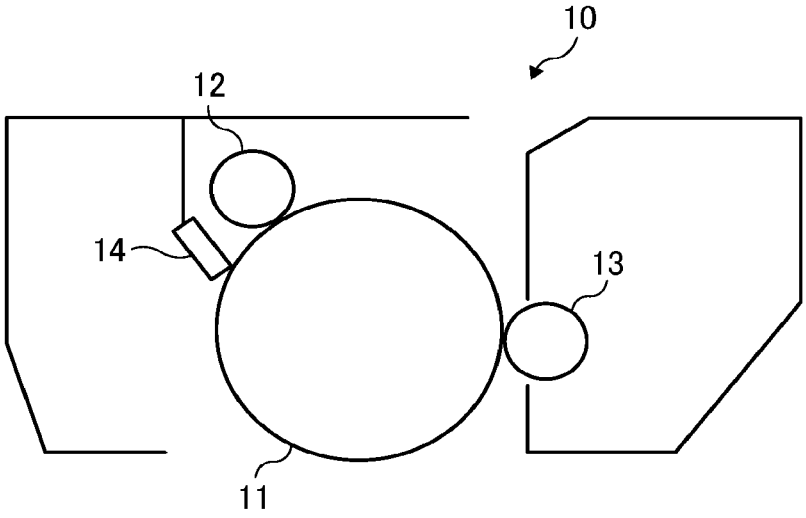
FIG. 2 is a schematic diagram illustrating a process cartridge according to an embodiment of the present invention.

The process cartridge according to an embodiment of the present invention is illustrated in FIG. 2. A process cartridge 10 includes: a photoconductor 11 serving as an electrostatic latent image bearer; a charger 12 configured to charge the photoconductor 11; a developing device 13 containing the developer according to an embodiment of the present invention, configured to develop the electrostatic latent image formed on the photoconductor 11 with the developer to form a toner image; and a cleaner 14 configured to remove residual toner remaining on the photoconductor 11 after the toner image formed on the photoconductor 11 has been transferred onto a recording medium. The process cartridge 10 is detachably mountable on an image forming apparatus such as a copier and a printer.

An image forming apparatus on which the process cartridge 10 is mounted forms an image in the following manner. First, the photoconductor 11 is driven to rotate at a certain peripheral speed. The circumferential surface of the photoconductor 11 is uniformly charged to a certain positive or negative potential by the charger 12. The charged circumferential surface of the photoconductor 11 is irradiated with exposure light emitted from an exposure device (e.g., slit exposure device, laser beam scanning exposure device), and an electrostatic latent image is formed thereon. The electrostatic latent image formed on the circumferential surface of the photoconductor 11 is developed with the developer according to an embodiment of the present invention contained in the developing device 13 to form a toner image. The toner image formed on the circumferential surface of the photoconductor 11 is transferred onto a transfer sheet which is fed from a sheet feeder to between the photoconductor 11 and a transfer device in synchronization with rotation of the photoconductor 11. The transfer sheet having the transferred toner image thereon is separated from the circumferential surface of the photoconductor 11 and introduced into a fixing device. The toner image is fixed on the transfer sheet in the fixing device and then output as a copy from the image forming apparatus. On the other hand, after the toner image has been transferred, the surface of the photoconductor 11 is cleaned by removing residual toner by the cleaner 14 and then neutralized by a neutralizer, so that the photoconductor 11 gets ready for a next image forming operation.

Image Forming Apparatus

An image forming apparatus according to an embodiment of the present invention includes: an electrostatic latent image bearer; a charger configured to charge the electrostatic latent image bearer; an irradiator configured to form an electrostatic latent image on the electrostatic latent image bearer: a developing device containing the two-component developer according to an embodiment of the present invention, configured to develop the electrostatic latent image formed on the electrostatic latent image bearer with the two-component developer to form a toner image; a transfer device configured to transfer the toner image formed on the electrostatic latent image bearer onto a recording medium; and a fixing device configured to fix the toner image on the recording medium. The image forming apparatus may further include other devices such as a neutralizer, a cleaner, a recycler, and a controller, as necessary.

EXAMPLES

Further understanding can be obtained by reference to certain specific examples which are provided herein for the purpose of illustration only and are not intended to be limiting. In the following descriptions, "parts" represents "parts by mass" and "%" represents "% by mass" unless otherwise specified.

Example 1

Composition of Resin Liquid 1

- Acrylic resin solution (solid content concentration: 20%): 200 parts
- Silicone resin solution (solid content concentration: 40%): 2,000 parts
- Aminosilane (solid content concentration: 100%): 35 parts
- Alumina surface-treated with tungsten-oxide-doped tin oxide (WTO) (powder resistivity: 40 Ω·cm): 1,160 parts
- Barium sulfate (average particle diameter: 0.60 μm): 680 parts
- Toluene: 6,000 parts
- Dispersing agent (phosphate-based surfactant): 37 parts
- Defoaming agent (silicone-based, solid content concentration: 1%): 550 parts The above materials are subjected to a dispersion treatment using a HOMOMIXER for 10 minutes, thus obtaining a resin liquid 1 for forming a resin layer. As a core particle, a Cu—Zn ferrite having a volume average particle diameter of 35 μm is used. The surface of the core particle is coated with the resin liquid 1 by a SPIRA COTA SP-40 (manufactured by Okada Seiko Co., Ltd.) at a rate of 30 g/min in an atmosphere having a temperature of 60 degrees C., followed by drying, so that the thickness of the coating layer becomes 0.50 μm. The core particle having the coating layer thereon is burnt in an electric furnace at 230 degrees C. for 1 hour, then cooled, and is pulverized with a sieve having an opening of 100 μm. Thus, a carrier 1 is prepared. The average thickness T between the surface of the core particle and the surface of the resin layer is 0.50 μm.

The volume average particle diameter of the core particle is measured by a particle size analyzer MICROTRAC SRA (manufactured by Nikkiso Co., Ltd.) while setting the measuring range to from 0.7 to 125 μm.

The thickness T (μm) between the surface of the core particle and the surface of the resin layer is determined by observing a cross-section of the carrier particle with a transmission electron microscope (TEM), measuring the thickness between the surface of the core particle and the surface of the resin layer at 50 points along the surface of the carrier particle at intervals of 0.2 μm, and averaging the measured values.

Example 2

A carrier 2 is prepared in the same manner as in Example 1 except that the phosphate-based surfactant is replaced with a sulfate-based surfactant.

Example 3

A carrier 3 is prepared in the same manner as in Example 1 except that the phosphate-based surfactant is replaced with a sulfonic-acid-based surfactant.

Example 4

A carrier 4 is prepared in the same manner as in Example 1 except that the phosphate-based surfactant is replaced with a carboxylic-acid-based surfactant.

Example 5

A carrier 5 is prepared in the same manner as in Example 1 except that the silicone-based defoaming agent is replaced with an acrylic-based defoaming agent.

Example 6

A carrier 6 is prepared in the same manner as in Example 1 except that the silicone-based defoaming agent is replaced with a vinyl-based defoaming agent.

Example 7

Composition of Resin Solution 7
Acrylic resin solution (solid content concentration: 20%): 200 parts
Silicone resin solution (solid content concentration: 40%): 2,000 parts
Aminosilane (solid content concentration: 100%): 35 parts
Alumina surface-treated with tungsten-oxide-doped tin oxide (WTO) (powder resistivity: 40 Ω·cm): 1,160 parts
Barium sulfate (average particle diameter: 0.60 μm): 680 parts
Toluene: 6,000 parts
Dispersing agent (phosphate-based surfactant): 10 parts
Defoaming agent (silicone-based, solid content concentration: 1%): 550 parts A carrier 7 is prepared in the same manner as in Example 1 except that the resin liquid 1 is replaced with the resin liquid 7.

Example 8

Composition of Resin Solution 8
Acrylic resin solution (solid content concentration: 20%): 200 parts
Silicone resin solution (solid content concentration: 40%): 2,000 parts
Aminosilane (solid content concentration: 100%): 35 parts
Alumina surface-treated with tungsten-oxide-doped tin oxide (WTO) (powder resistivity: 40 Ω·cm): 1,160 parts
Barium sulfate (average particle diameter: 0.60 μm): 680 parts
Toluene: 6,000 parts
Dispersing agent (phosphate-based surfactant): 180 parts
Defoaming agent (silicone-based, solid content concentration: 1%): 550 parts A carrier 8 is prepared in the same manner as in Example 1 except that the resin liquid 1 is replaced with the resin liquid 8.

Example 9

Composition of Resin Solution 9
Acrylic resin solution (solid content concentration: 20%): 200 parts
Silicone resin solution (solid content concentration: 40%): 2,000 parts
Aminosilane (solid content concentration: 100%): 35 parts
Alumina surface-treated with tungsten-oxide-doped tin oxide (WTO) (powder resistivity: 40 Ω·cm): 1,160 parts
Barium sulfate (average particle diameter: 0.60 μm): 680 parts
Toluene: 6,000 parts
Dispersing agent (phosphate-based surfactant): 37 parts
Defoaming agent (silicone-based, solid content concentration: 1%): 160 parts A carrier 9 is prepared in the same manner as in Example 1 except that the resin liquid 1 is replaced with the resin liquid 9.

Example 10

Composition of Resin Liquid 10
Acrylic resin solution (solid content concentration: 20%): 200 parts
Silicone resin solution (solid content concentration: 40%): 2,000 parts
Aminosilane (solid content concentration: 100%): 35 parts
Alumina surface-treated with tungsten-oxide-doped tin oxide (WTO) (powder resistivity: 40 Ω·cm): 1,160 parts
Barium sulfate (average particle diameter: 0.60 μm): 680 parts
Toluene: 6,000 parts
Dispersing agent (phosphate-based surfactant): 37 parts
Defoaming agent (silicone-based, solid content concentration: 1%): 940 parts A carrier 10 is prepared in the same manner as in Example 1 except that the resin liquid 1 is replaced with the resin liquid 10.

Example 11

Composition of Resin Liquid 11
Acrylic resin solution (solid content concentration: 20%): 200 parts
Silicone resin solution (solid content concentration: 40%): 2,000 parts
Aminosilane (solid content concentration: 100%): 35 parts
Alumina surface-treated with tungsten-oxide-doped tin oxide (WTO) (powder resistivity: 40 Ω·cm): 1,160 parts
Barium sulfate (average particle diameter: 0.60 μm): 680 parts
Toluene: 6,000 parts
Dispersing agent (phosphate-based surfactant): 7 parts
Defoaming agent (silicone-based, solid content concentration: 1%): 550 parts A carrier 11 is prepared in the same manner as in Example 1 except that the resin liquid 1 is replaced with the resin liquid 11.

Example 12

Composition of Resin Solution 12
Acrylic resin solution (solid content concentration: 20%): 200 parts
Silicone resin solution (solid content concentration: 40%): 2,000 parts
Aminosilane (solid content concentration: 100%): 35 parts Alumina surface-treated with tungsten-oxide-doped tin oxide (WTO) (powder resistivity: 40 Ω·cm): 1,160 parts Barium sulfate (average particle diameter: 0.60 μm): 680 parts Toluene: 6,000 parts Dispersing agent (phosphate-based surfactant): 190 parts Defoaming agent (silicone-based, solid content concentration: 1%): 550 parts A carrier 12 is prepared in the same manner as in Example 1 except that the resin liquid 1 is replaced with the resin liquid 12.

Example 13

Composition of Resin Solution 13

Acrylic resin solution (solid content concentration: 20%): 200 parts

Silicone resin solution (solid content concentration: 40%): 2,000 parts

Aminosilane (solid content concentration: 100%): 35 parts

Alumina surface-treated with tungsten-oxide-doped tin oxide (WTO) (powder resistivity: 40 Ω·cm): 1,160 parts Barium sulfate (average particle diameter: 0.60 μm): 680 parts Toluene: 6,000 parts Dispersing agent (phosphate-based surfactant): 37 parts Defoaming agent (silicone-based, solid content concentration: 1%): 100 parts A carrier 13 is prepared in the same manner as in Example 1 except that the resin liquid 1 is replaced with the resin liquid 13.

Example 14

Composition of Resin Solution 14

Acrylic resin solution (solid content concentration: 20%): 200 parts

Silicone resin solution (solid content concentration: 40%): 2,000 parts

Aminosilane (solid content concentration: 100%): 35 parts

Alumina surface-treated with tungsten-oxide-doped tin oxide (WTO) (powder resistivity: 40 Ω·cm): 1,160 parts Barium sulfate (average particle diameter: 0.60 μm): 680 parts Toluene: 6,000 parts Dispersing agent (phosphate-based surfactant): 37 parts Defoaming agent (silicone-based, solid content concentration: 1%): 1,030 parts A carrier 14 is prepared in the same manner as in Example 1 except that the resin liquid 1 is replaced with the resin liquid 14.

Example 15

A carrier 15 is prepared in the same manner as in Example 1 except that the barium sulfate is replaced with a magnesium oxide (average particle diameter: 0.55 μm).

Example 16

A carrier 16 is prepared in the same manner as in Example 1 except that the barium sulfate is replaced with a magnesium hydroxide (average particle diameter: 0.61 μm).

Example 17

A carrier 17 is prepared in the same manner as in Example 1 except that the barium sulfate is replaced with a hydrotalcite (average particle diameter: 0.58 μm).

Example 18

A carrier 18 is prepared in the same manner as in Example 1 except that the alumina surface-treated with tungsten-oxide-doped tin oxide (WTO) is replaced with an alumina surface-treated with indium-oxide-doped tin oxide (ITO) (powder resistivity: 20 Ω·m).

Example 19

A carrier 19 is prepared in the same manner as in Example 1 except that the alumina surface-treated with tungsten-oxide-doped tin oxide (WTO) is replaced with an alumina surface-treated with phosphorus-oxide-doped tin oxide (PTO) (powder resistivity: 210 Ω·cm).

Comparative Example 1

Composition of Resin Solution 20

Acrylic resin solution (solid content concentration: 20%): 200 parts

Silicone resin solution (solid content concentration: 40%): 2,000 parts

Aminosilane (solid content concentration: 100%): 35 parts

Alumina surface-treated with tungsten-oxide-doped tin oxide (WTO) (powder resistivity: 40 Ω·cm): 1,160 parts Barium sulfate (average particle diameter: 0.60 μm): 680 parts Toluene: 6,000 parts Dispersing agent (phosphate-based surfactant): 0 part Defoaming agent (silicone-based, solid content concentration: 1%): 0 part A carrier 20 is prepared in the same manner as in Example 1 except that the resin liquid 1 is replaced with the resin liquid 20.

Comparative Example 2

Composition of Resin Solution 21

Acrylic resin solution (solid content concentration: 20%): 200 parts

Silicone resin solution (solid content concentration: 40%): 2,000 parts

Aminosilane (solid content concentration: 100%): 35 parts

Alumina surface-treated with tungsten-oxide-doped tin oxide (WTO) (powder resistivity: 40 Ω·cm): 1,160 parts Barium sulfate (average particle diameter: 0.60 μm): 680 parts Toluene: 6,000 parts Dispersing agent (phosphate-based surfactant): 37 parts Defoaming agent (silicone-based, solid content concentration: 1%): 0 part A carrier 21 is prepared in the same manner as in Example 1 except that the resin liquid 1 is replaced with the resin liquid 21.

Properties of the above-prepared carriers are presented in Table 1. In Table 1, "dispersing agent addition amount (parts)" represents "addition amount (parts) of the dispersing agent with respect to 100 parts by mass of the chargeable particle A and the conductive particle B in total", and "defoaming agent addition amount (parts)" represents "addition amount of solid contents of the defoaming agent with respect to 100 parts by mass of solid contents of the acrylic resin solution, solid contents of the silicon resin solution, aminosilane, the chargeable particle A, the conductive particle B. and the dispersing agent in total.

TABLE 1

| | Carrier No. | Dispersing Agent | Defoaming Agent | Addition Amount of Dispersing Agent (parts) | Addition Amount of Defoaming Agent (parts) | Chargeable Particle A | Conductive Particle B |
|---|---|---|---|---|---|---|---|
| Ex. 1 | 1 | Phosphate-based surfactant | Silicone-based | 2.0 | 0.20 | Barium sulfate | WTO-treated alumina |
| Ex. 2 | 2 | Sulfate-based surfactant | Silicone-based | 2.0 | 0.20 | Barium sulfate | WTO-treated alumina |
| Ex. 3 | 3 | Sulfonic-acid-based surfactant | Silicone-based | 2.0 | 0.20 | Barium sulfate | WTO-treated alumina |
| Ex. 4 | 4 | Carboxylic-acid-based surfactant | Silicone-based | 2.0 | 0.20 | Barium sulfate | WTO-treated alumina |
| Ex. 5 | 5 | Phosphate-based surfactant | Acrylic-based | 2.0 | 0.20 | Barium sulfate | WTO-treated alumina |
| Ex. 6 | 6 | Phosphate-based surfactant | Vinyl-based | 2.0 | 0.20 | Barium sulfate | WTO-treatcd alumina |
| Ex. 7 | 7 | Phosphate-based surfactant | Silicone-based | 0.5 | 0.20 | Barium sulfate | WTO-treated alumina |
| Ex. 8 | 8 | Phosphate-based surfactant | Silicone-based | 9.8 | 0.19 | Barium sulfate | WTO-treated alumina |
| Ex. 9 | 9 | Phosphate-based surfactant | Silicone-based | 2.0 | 0.06 | Barium sulfate | WTO-treated alumina |
| Ex. 10 | 10 | Phosphate-based surfactant | Silicone-based | 2.0 | 0.34 | Barium sulfate | WTO-treated alumina |
| Ex. 11 | 11 | Phosphate-based surfactant | Silicone-based | 0.4 | 0.20 | Barium sulfate | WTO-treated alumina |
| Ex. 12 | 12 | Phosphate-based surfactant | Silicone-based | 10.3 | 0.19 | Barium sulfate | WTO-treated alumina |
| Ex. 13 | 13 | Phosphate-based surfactant | Silicone-based | 2.0 | 0.04 | Barium sulfate | WTO-treated alumina |
| Ex. 14 | 14 | Phosphate-based surfactant | Silicone-based | 2.0 | 0.37 | Barium sulfate | WTO-treatcd alumina |
| Ex. 15 | 15 | Phosphate-based surfactant | Silicone-based | 2.0 | 0.20 | Magnesium oxide | WTO-treated alumina |
| Ex. 16 | 16 | Phosphate-based surfactant | Silicone-based | 2.0 | 0.20 | Magnesium hydroxide | WTO-treated alumina |
| Ex. 17 | 17 | Phosphate-based surfactant | Silicone-based | 2.0 | 0.20 | Hydrotalcite | WTO-treated alumina |
| Ex. 18 | 18 | Phosphate-based surfactant | Silicone-based | 2.0 | 0.20 | Barium sulfate | ITO-treated alumina |
| Ex. 19 | 19 | Phosphate-based surfactant | Silicone-based | 2.0 | 0.20 | Barium sulfate | PTO-treated alumina |
| Comp. Ex. 1 | 20 | — | — | — | — | Barium sulfate | WTO-treated alumina |
| Comp. Ex. 2 | 21 | Phosphate-based surfactant | — | 2.0 | — | Barium sulfate | WTO-treated alumina |

Toner Production Example

Synthesis of Polyester Resin A

In a reaction vessel equipped with a condenser tube, a stirrer, and a nitrogen introducing tube, 65 parts of ethylene oxide 2-mol adduct of bisphenol A, 86 parts of propylene oxide 3-mol adduct of bisphenol A, 274 parts of terephthalic acid, and 2 parts of dibutyltin oxide are put and allowed to react at 230 degrees C. under normal pressure for 15 hours. The reaction is further continued under reduced pressures of from 5 to 10 mmHg for 6 hours. Thus, a polyester resin A is prepared. The polyester resin A is found to have a number average molecular weight (Mn) of 2,300, a weight average molecular weight (Mw) of 8,000, a glass transition temperature (Tg) of 58 degrees C. an acid value of 25 mgKOH/g, and a hydroxyl value of 35 mgKOH/g.

Synthesis of Prepolymer (Polymer Reactive with Compound Having Active Hydrogen Group)

In a reaction vessel equipped with a condenser tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide are put and allowed to react at 230 degrees C. under normal pressure for 8 hours. The reaction is further continued under reduced pressures of from 10 to 15 mmHg for 5 hours. Thus, an intermediate polyester is prepared.

The intermediate polyester is found to have a number average molecular weight (Mn) of 2,100, a weight average molecular weight (Mw) of 9,600, a glass transition temperature (Tg) of 55 degrees C., an acid value of 0.5, and a hydroxyl value of 49.

In a reaction vessel equipped with a condenser tube, a stirrer, and a nitrogen introducing tube, 411 parts of the intermediate polyester, 89 parts of isophorone diisocyanate, and 500 parts of ethyl acetate are put and allowed to react at 100 degrees C. for 5 hours, thus preparing a prepolymer (i.e., polymer reactive with a compound having an active hydrogen group).

The proportion of free isocyanate in the prepolymer is 1.60% by mass. The solid content concentration of the prepolymer is 50% by mass (when measured at 150 degrees C. after leaving the prepolymer to stand for 45 minutes).

Synthesis of Ketimine (Compound Having Active Hydrogen Group)

In a reaction vessel equipped with a stirrer and a thermometer, 30 parts of isophoronediamine and 70 parts of methyl ethyl ketone are put and allowed to react at 50 degrees C. for 5 hours. Thus, a ketimine compound (i.e., the compound having an active hydrogen group) is prepared. The ketimine compound (i.e., the compound having an active hydrogen group) is found to have an amine value of 423.

Preparation of Master Batch

First, 1,000 parts of water, 540 parts of a carbon black PRINTEX 35 (manufactured by Degussa AG) having a DBP oil absorption amount of 42 mL/100 g and a pH of 9.5, and 1,200 parts of the polyester resin A are mixed with a HENSCHEL MIXER (manufactured by Mitsui Mining Co., Ltd.). Next, the resulted mixture is kneaded by a two-roll extruder at 150 degrees C. for 30 minutes, is cooled by rolling, and is pulverized by a pulverizer (manufactured by Hosokawa Micron Corporation). Thus, a master batch is prepared.

Preparation of Aqueous Medium

An aqueous medium is prepared by dissolving 265 parts of a 10% by mass suspension of tricalcium phosphate and 1.0 part of sodium dodecylbenzenesulfonate in 306 parts of ion-exchange water by uniformly mixing and stirring them.

Measurement of Critical Micelle Concentration

The critical micelle concentration of surfactants is measured in the following manner. An analysis is performed using an analysis program installed in the system of a surface tensiometer SIGMA (manufactured by KSV Instruments Ltd.). A surfactant is dropped in the aqueous medium with each drop having a proportion of 0.01% to the aqueous medium. After the aqueous medium had been stirred and allowed to stand, the interfacial tension is measured. From the resulted surface tension curve, the surfactant concentration at which the interfacial tension does not decrease even when the surfactant is further dropped is calculated as the critical micelle concentration. The critical micelle concentration of sodium dodecylbenzenesulfonate with respect to the aqueous medium, measured using the surface tensiometer SIGMA, is 0.05% with respect to the mass of the aqueous medium.

Preparation of Toner Material Liquid

In a beaker, 70 parts of the polyester resin A and 10 parts of the prepolymer are dissolved in 100 parts of ethyl acetate by stirring. Further, 5 parts of a paraffin wax (HNP-9 manufactured by Nippon Seiro Co., Ltd., having a melting point of 75 degrees C.) as a release agent, 2 parts of MEK-ST (manufactured by Nissan Chemical Corporation), and 10 parts of the master batch are added to the beaker and subjected to a dispersing treatment using a bead mill (ULTRAVISCOMILL manufactured by AIMEX CO., LTD.) filled with 80% by volume of zirconia beads having a particle diameter of 0.5 mm at a liquid feeding speed of 1 kg/hour and a disc peripheral speed of 6 m/sec. After performing this dispersing operation 3 times (3 passes), 2.7 parts of the ketimine is dissolved therein. Thus, a toner material liquid is prepared.

Preparation of Emulsion or Liquid Dispersion

In a vessel, 150 parts of the aqueous medium is stirred by a TK HOMOMIXER (manufactured by Tokushu Kika Kogyo Co., Ltd.) at a revolution of 12,000 rpm, and 100 parts of the toner material liquid are added thereto and mixed for 10 minutes. Thus, an emulsion or liquid dispersion (hereinafter "emulsion slurry") is prepared.

Removal of Organic Solvent

In a flask equipped with a stirrer and a thermometer, 100 parts of the emulsion slurry is placed and stirred at a stirring peripheral speed of 20 m/min at 30 degrees C. for 12 hours to remove the solvent. Thus, a dispersion slurry is prepared.

Washing

First, 100 parts of the dispersion slurry are filtered under reduced pressures. The resulted filter cake is mixed with 100 parts of ion-exchange water by a TK HOMOMIXER (at a revolution of 12,000 rpm for 10 minutes) and then filtered. The resulted filter cake is mixed with 300 parts of ion-exchange water by a TK HOMOMIXER (at a revolution of 12,000 rpm for 10 minutes) and then filtered. This operation is repeated twice. The resulted filter cake is mixed with 20 parts of a 10% by mass aqueous solution of sodium hydroxide by a TK HOMOMIXER (at a revolution of 12,000 rpm for 30 minutes) and then filtered under reduced pressures. The resulted filter cake is mixed with 300 parts of ion-exchange water by a TK HOMOMIXER (at a revolution of 12,000 rpm for 10 minutes) and then filtered. The resulted filter cake is mixed with 300 parts of ion-exchange water by a TK HOMOMIXER (at a revolution of 12,000 rpm for 10 minutes) and then filtered. This operation is repeated twice. The resulted filter cake is mixed with 20 parts of a 10% by mass aqueous solution of hydrochloric acid by a TK HOMOMIXER (at a revolution of 12,000 rpm for 10 minutes) and then filtered.

Adjustment of Amount of Surfactant

The filter cake prepared in the above washing process is mixed with 300 parts of ion-exchange water by a TK HOMOMIXER (at a revolution of 12,000 rpm for 10 minutes) to prepare a toner dispersion liquid. The electrical conductivity of this toner dispersion liquid is measured, and the surfactant concentration thereof is calculated with reference to the surfactant concentration calibration curve created in advance. The toner dispersion liquid is further added with ion-exchange water so that the calculated surfactant concentration becomes the target surfactant concentration of 0.05%.

Surface Treatment Process

The toner dispersion liquid adjusted to have the specified surfactant concentration is heated in a water bath at a heating temperature T1 of 55 degrees C. for 10 hours while being stirred at 5,000 rpm by a TK HOMOMIXER. The toner dispersion liquid is thereafter cooled to 25 degrees C. and then filtered. The resulted filter cake is mixed with 300 parts of ion-exchange water by a TK HOMOMIXER (at a revolution of 12.000 rpm for 10 minutes) and then filtered.

Drying

The resulted final filter cake is dried by a circulating air dryer at 45 degrees C. for 48 hours and then filtered with a mesh having an opening of 75 μm. Thus, toner mother particles 1 are prepared.

External Addition Treatment

Next, 100 parts of the toner mother particles 1 are mixed with 3.0 parts of a hydrophobic silica having an average particle diameter of 100 nm, 1.0 part of a titanium oxide having an average particle diameter of 20 nm, and 1.5 parts of a hydrophobic silica powder having an average particle diameter of 15 nm using a HENSCHEL MIXER. Thus, a toner 1 is prepared.

Preparation of Developer

Each of the carriers 1 to 21 (93 parts) prepared in Examples and Comparative Examples is stir-mixed with the toner 1 (7 parts) by a TURBULA MIXER at a revolution of 81 rpm for 3 minutes. Thus, developers 1 to 21 are prepared for evaluation. Further, developers for replenishment corresponding to these developers are prepared using each carrier and the toner such that the toner concentration became 95%.

Developer Property Evaluations

The above-prepared developers 1 to 21 are subjected to the following evaluations. To evaluate carrier deposition at the initial stage of printing where scraping of the coating resin film does not occur, the following Developer Property Evaluation 1 is performed to evaluate carrier deposition at solid portions at the initial stage. To evaluate a resistance decrease over time during printing, the following Developer Property Evaluation 2 is performed to evaluate carrier deposition at solid portions over time. To evaluate the charge imparting property to toner, the following Developer Property Evaluation 3 is performed to evaluate charge rising property, time-dependent charge stability, and toner scattering. A digital full-color multifunction peripheral (PRO C9100 manufactured by Ricoh Co., Ltd.), which is a high-speed color production printer, is used for the evaluations. The following Developer Property Evaluations 2 and 3 are performed by continuous printing at a printing density with a low image area rate with a high-speed machine using a low-temperature-fixing toner.

Developer Property Evaluation 1

Each of the above-prepared developers is put in a commercially-available digital full-color multifunction peripheral (PRO C9100 manufactured by Ricoh Co., Ltd.) for image evaluation as follows.

Carrier Deposition at Solid Portions

The above machine is placed in an environmental evaluation room (in an environment of 25 degrees C., 60% RH) and each of the developers 1 to 21 is put therein.

A process of forming a solid image under a specific development condition (with a charging potential (Vd) of −600 V, a potential of −100 V at the portion corresponding to the image portion (solid portion) after exposure, and a development bias DC of −500 V) is conducted but interrupted by turning off the power supply, to count the number of carrier-deposited portions on the photoconductor after image transfer. Specifically, a 10 mm×100 mm area on the photoconductor is subjected to evaluation. In Table 2, A represents a state in which the number of carrier-deposited portions is 0, B represents a state in which the number of carrier-deposited portions is 1 to 3. C represents a state in which the number of carrier-deposited portions is 4 to 10, and D represents a state in which the number of carrier-deposited portions is 11 or more. A, B, and C are acceptable levels, and D is unacceptable level.

Developer Property Evaluation 2

Each of the above-prepared developers is put in a commercially-available digital full-color multifunction peripheral (PRO C9100 manufactured by Ricoh Co., Ltd.) for image evaluation as follows. Specifically, the above machine is placed in an environmental evaluation room (in an environment of 25 degrees C., 60% RH) and a running test in which an image having an image area rate of 0.5% is continuously produced on 1,000,000 sheets is performed using each of the developers 1 to 21 and those for replenishment. After completion of the running test, carrier deposition is evaluated at solid portions. The evaluation is performed in the same manner as described above except for being performed after the running test on 1,000,000 sheets.

Developer Property Evaluation 3

Charge Rising Property

First, 93% by mass of the initial carrier and 7% by mass of the toner are mixed to prepare a triboelectrically-charged sample. The amount of charge of the sample is measured using a blow-off device TB-200 manufactured by Toshiba Chemical Corporation. A charge amount Q1 and a charge amount Q2 are measured 15 seconds after and 600 seconds after, respectively, of the start of mixing of the carrier and the toner. The charge rising property is defined as an absolute value of (Q1−Q2)/(Q1)×100. The evaluation criteria are as follows.

15 or more: A (Very good)

10 or more and less than 15: B (Good)

5 or more and less than 10: C (Acceptable)

0 or more and less than 5: D (Poor)

Time-Dependent Charge Stability

Using a digital full-color multifunction peripheral (PRO C9100 manufactured by Ricoh Co., Ltd.) and each of the developers 1 to 21 and those for replenishment, a running test in which an image having an image area rate of 40% is continuously produced on 1,000,000 sheets is performed. After completion of the running test, the carriers are subjected to an evaluation.

An initial charge amount (Q1) of each carrier is measured by preparing a sample by mixing each of the carriers 1 to 21 and the toner 1 (mass ratio=93:7), then triboelectrically charging the sample, and measuring the charge amount of the sample using a blow off device TB-200 (manufactured by Toshiba Chemical Corporation). A charge amount (Q2) of each carrier after the running test on 1,000,000 sheets is measured in the same manner as above except that the carrier is taken out from the developer used in the running test by removing the toner using the blow off device. The rate of change of charge amount is defined as an absolute value of (Q1−Q2)/(Q1)×100. The evaluation criteria are as follows.

0 or more and less than 5: A (Very good)

5 or more and less than 10: B (Good)

10 or more and less than 20: C (Acceptable)

20 or more: D (Poor)

Toner Scattering

Using a digital full-color multifunction peripheral (PRO C9100 manufactured by Ricoh Co., Ltd.) and each of the developers 1 to 21 and those for replenishment, a running test in which an image having an image area rate of 40% is continuously produced on 1,000,000 sheets is performed. After completion of the running test, the toner accumulated below the developer bearer is sucked and collected, and the mass thereof is measured. The evaluation criteria are as follows.

0 mg or more and less than 50 mg: A (Very good)
50 mg or more and less than 100 mg: B (Good)
100 mg or more and less than 250 mg: C (Acceptable)
250 mg or more: D (Poor)

The results of image evaluation are presented in Table 2.

TABLE 2

| | Developer No. | Carrier Deposition at Solid Portions at Initial Stage | Carrier Deposition at Solid Portions With Time | Charge Rising Property | Time-dependent Charge Stability | Toner Scattering |
|---|---|---|---|---|---|---|
| Ex. 1 | 1 | A | A | A | A | A |
| Ex. 2 | 2 | B | B | C | A | B |
| Ex. 3 | 3 | B | B | C | A | B |
| Ex. 4 | 4 | B | B | C | A | B |
| Ex. 5 | 5 | A | B | A | B | B |
| Ex. 6 | 6 | A | B | A | B | B |
| Ex. 7 | 7 | B | B | B | B | B |
| Ex. 8 | 8 | A | B | A | B | B |
| Ex. 9 | 9 | A | B | A | B | B |
| Ex. 10 | 10 | B | B | A | B | B |
| Ex. 11 | 11 | C | C | C | B | C |
| Ex. 12 | 12 | A | C | A | C | B |
| Ex. 13 | 13 | A | C | A | C | C |
| Ex. 14 | 14 | C | C | A | C | C |
| Ex. 15 | 15 | B | B | A | B | B |
| Ex. 16 | 16 | B | B | A | B | B |
| Ex. 17 | 17 | B | B | A | B | B |
| Ex. 18 | 18 | B | B | A | A | A |
| Ex. 19 | 19 | B | B | A | A | A |
| Comp. Ex. 1 | 20 | D | C | D | B | D |
| Comp. Ex. 2 | 21 | A | D | A | D | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure, and all such modifications are intended to be included within the scope of the present disclosure.

The invention claimed is:

1. A carrier for forming an electrophotographic image, comprising:

a core particle; and a resin layer coating the core particle, the resin layer containing a chargeable particle A, a conductive particle B, a dispersing agent, and a defoaming agent.

2. The carrier according to claim 1, wherein the dispersing agent is a phosphate-based surfactant.

3. The carrier according to claim 1, wherein the defoaming agent is a silicone-based defoaming agent.

4. The carrier according to claim 1, wherein the chargeable particle A comprises at least one inorganic particle selected from the group consisting of barium sulfate, magnesium oxide, magnesium hydroxide, and hydrotalcite.

5. The carrier according to claim 1, wherein the conductive particle B comprises at least one member selected from the group consisting of:

a particle of a doped tin oxide doped with at least one member selected from the group consisting of tungsten, indium, phosphorus, tungsten oxides, indium oxides, and phosphorus oxides; and a particle comprising a base particle and the doped tin oxide on a surface of the base particle.

6. The carrier according claim 1, wherein the conductive particle B is an alumina base particle surface-treated with a doped tin oxide, the doped tin oxide selected from the group consisting of tungsten-doped tin oxides and tungsten-oxide-doped tin oxides.

7. The carrier according to claim 6, wherein the chargeable particle A is barium sulfate.

8. The carrier according to claim 1, wherein an amount of the dispersing agent is from 0.5 to 10.0 parts by mass with respect to 100 parts by mass of the chargeable particle A and the conductive particle B in total.

9. The carrier according to claim 1, wherein an amount of solid contents of the defoaming agent is from 0.05 to 0.35 parts by mass with respect to 100 parts by mass of the resin layer.

10. The carrier according to claim 1, wherein the dispersing agent is a phosphate, and the defoaming agent is a silicone oil.

11. A developer for forming an electrophotographic image, comprising:

the carrier according to claim 1; and a toner.

12. An electrophotographic image forming method comprising:

forming an electrostatic latent image on an electrostatic latent image bearer;

developing the electrostatic latent image formed on the electrostatic latent image bearer with the developer according to claim 11 to form a toner image;

transferring the toner image formed on the electrostatic latent image bearer onto a recording medium; and fixing the toner image on the recording medium.

13. An electrophotographic image forming apparatus comprising:

an electrostatic latent image bearer;

a charger configured to charge the electrostatic latent image bearer;

an irradiator configured to form an electrostatic latent image on the electrostatic latent image bearer;

a developing device containing the developer according to claim 11, the developing device configured to develop the electrostatic latent image formed on the electrostatic latent image bearer with the developer to form a toner image;

a transfer device configured to transfer the toner image formed on the electrostatic latent image bearer onto a recording medium; and a fixing device configured to fix the toner image on the recording medium.

14. A process cartridge comprising:

an electrostatic latent image bearer;

a charger configured to charge the electrostatic latent image bearer;

a developing device containing the developer according to claim 11, the developing device configured to develop an electrostatic latent image formed on the electrostatic latent image bearer with the developer to form a toner image; and a cleaner configured to clean the electrostatic latent image bearer.

15. The carrier according to claim 1, wherein the resin layer comprises a silicone resin.

16. The carrier according to claim 15, wherein the defoaming agent is a silicone oil.

17. The carrier according to claim 1, wherein an amount of the dispersing agent is from 0.5 to 10.0 parts by mass with respect to 100 parts by mass of the chargeable particle A and the conductive particle B in total, and wherein an amount of solid contents of the defoaming agent is from 0.05 to 0.35 parts by mass with respect to 100 parts by mass of the resin layer.

* * * * *